US007234382B2

(12) United States Patent
Zhu

(10) Patent No.: US 7,234,382 B2
(45) Date of Patent: Jun. 26, 2007

(54) SLICER WITH UNITARY HANDLE

(75) Inventor: Guangshan Zhu, Troy, OH (US)

(73) Assignee: Premark FEG L.L.C., Wilmington, DE (US)

( * ) Notice: Subject to any disclaimer, the term of this patent is extended or adjusted under 35 U.S.C. 154(b) by 876 days.

(21) Appl. No.: 09/571,803

(22) Filed: May 16, 2000

(65) Prior Publication Data

US 2002/0069737 A1 Jun. 13, 2002

(51) Int. Cl.
*B26D 7/06* (2006.01)

(52) U.S. Cl. ..... 83/729; 83/393; 83/730; 83/932

(58) Field of Classification Search ..... D7/383, D7/393, 394; 83/932, 729
See application file for complete search history.

(56) References Cited

U.S. PATENT DOCUMENTS

| | | | | | |
|---|---|---|---|---|---|
| 1,518,474 | A | | 12/1924 | Wile | 83/167 |
| 1,674,385 | A | * | 6/1928 | Wolff | 83/729 |
| 1,742,576 | A | * | 1/1930 | Campbell | 83/729 |
| 1,912,922 | A | | 6/1933 | Streckfuss | 83/421 |
| 1,954,605 | A | * | 4/1934 | Van Berkel | D7/383 X |
| D92,770 | S | * | 7/1934 | Reussenzehn | D7/383 |
| 2,004,603 | A | | 6/1935 | Folk | 83/729 |
| 2,010,944 | A | | 8/1935 | Campbell | 83/717 |
| 2,086,759 | A | | 7/1937 | Wood | 83/730 |
| 2,121,351 | A | * | 6/1938 | van Berkel | 83/729 |
| 2,126,380 | A | * | 8/1938 | Folk | 83/729 |
| 2,136,792 | A | | 11/1938 | Folk | 83/730 |
| D129,559 | S | * | 9/1941 | Wood | D7/383 |
| 2,402,519 | A | | 6/1946 | Wood | 83/730 |
| 2,404,557 | A | * | 7/1946 | Wood | 83/729 |
| D148,203 | S | * | 12/1947 | Walker | D7/381 |
| D155,292 | S | * | 9/1949 | Klingens et al. | D7/383 |
| D159,734 | S | * | 8/1950 | Karp | D7/383 |
| D165,082 | S | * | 11/1951 | Little | D7/383 |
| 2,573,860 | A | | 11/1951 | Meeker et al. | 83/729 |
| 2,573,861 | A | | 11/1951 | Meeker et al. | 83/729 |
| 2,744,554 | A | | 5/1956 | King | 83/707 |
| 2,822,011 | A | * | 2/1958 | Lundell | 83/729 |
| 2,970,623 | A | | 2/1961 | Lundell | 83/703 |
| D190,051 | S | * | 4/1961 | Lundell | D7/383 |

(Continued)

FOREIGN PATENT DOCUMENTS

| | | |
|---|---|---|
| CH | 270526 | 9/1950 |

(Continued)

OTHER PUBLICATIONS

Declaration of Guangshan Zhu (executed Jun. 7, 2001).

(Continued)

*Primary Examiner*—Boyer D. Ashley
(74) *Attorney, Agent, or Firm*—Thompson Hine LLP

(57) ABSTRACT

A slicer comprising a slicer body including a rotatable blade for slicing a product, and a tray mounted for reciprocal movement relative the slicer body and for supporting and moving the product relative the blade. The tray includes a tray body and a unitary handle. In another embodiment, the invention is a slicer including a slicer body having a rotatable blade for slicing a product and a tray for supporting the product and moving the product relative the blade. The slicer further includes a handle unitary with the tray, the handle providing a surface which a user may grip to manually move the tray.

25 Claims, 17 Drawing Sheets

U.S. PATENT DOCUMENTS

| | | | | | |
|---|---|---|---|---|---|
| D192,812 | S | * | 5/1962 | Hvale et al. | D7/394 |
| 3,159,196 | A | | 12/1964 | Engi | 83/399 |
| 3,704,736 | A | | 12/1972 | Pratley | 83/397 |
| 3,927,588 | A | | 12/1975 | Laderach | 83/15 |
| 3,972,256 | A | | 8/1976 | Ross | 83/155 |
| 3,974,725 | A | | 8/1976 | Boots | 83/100 |
| 4,038,892 | A | | 8/1977 | Popeil | 83/4 |
| 4,070,941 | A | | 1/1978 | Lorenz | 83/478 |
| 4,217,650 | A | | 8/1980 | Kuchler | 702/175 |
| 4,246,818 | A | | 1/1981 | McGraw, Jr. | 83/478 |
| 4,318,321 | A | | 3/1982 | De Mattos | 83/71 |
| 4,379,416 | A | | 4/1983 | Kuchler | 83/23 |
| D269,347 | S | | 6/1983 | Cantatore et al. | D7/383 |
| 4,397,206 | A | | 8/1983 | Czala | 83/399 |
| 4,541,319 | A | | 9/1985 | Maurer et al. | 83/707 |
| 4,598,618 | A | | 7/1986 | Kuchler | 83/77 |
| 4,598,620 | A | | 7/1986 | Flammann | 83/399 |
| 4,685,364 | A | | 8/1987 | Scheflow et al. | 83/68 |
| 4,747,331 | A | | 5/1988 | Policella | 83/762 |
| 4,763,738 | A | | 8/1988 | Kuchler | 177/50 |
| 4,813,316 | A | | 3/1989 | Johnson et al. | 83/42 |
| 5,121,554 | A | | 6/1992 | Havins | 33/640 |
| 5,241,885 | A | | 9/1993 | Kuchler | 83/76.7 |
| 5,245,898 | A | | 9/1993 | Somal et al. | 83/58 |
| D348,177 | S | * | 6/1994 | Kelly et al. | D7/381 |
| 5,509,337 | A | | 4/1996 | Norman et al. | 83/546 |
| 5,615,591 | A | | 4/1997 | Scherch et al. | 83/399 |
| 5,687,626 | A | | 11/1997 | Scherch et al. | 83/719 |
| D418,011 | S | * | 12/1999 | van Dullemen et al. | D7/383 |
| 6,167,791 | B1 | * | 1/2001 | Heckman et al. | 83/729 X |
| 6,209,438 | B1 | | 4/2001 | Mitchell et al. | 83/729 |

FOREIGN PATENT DOCUMENTS

| | | | |
|---|---|---|---|
| DE | 110775 | | 4/1899 |
| DE | 1196985 | | 7/1965 |
| DE | 2749652 | | 5/1979 |
| DE | 3201520 | A1 | 7/1983 |
| DE | 4434364 | | 3/1996 |
| GB | 409723 | | 5/1934 |
| GB | 438208 | | 11/1935 |
| GB | 599781 | | 3/1948 |
| GB | 934985 | | 8/1963 |
| GB | 2090122 | A | 7/1982 |

OTHER PUBLICATIONS

Declaration of Danny J. Mitchell and Neal H. Blackburn (executed Jun. 6, and Jun. 24, 2000).

International Search Report issued Nov. 14, 2001, regarding corresponding PCT International Application No. PCT/US01/12845.

* cited by examiner

SLICER WITH UNITARY HANDLE

TECHNICAL FIELD

The present invention is directed to a food slicer having a unitary handle.

BACKGROUND OF THE INVENTION

Commercial food product slicers are widely utilized as rapid and effective means for slicing meat, cheese, vegetables and other food products. Such a slicer is shown in U.S. application Ser. No. 09/470,351, filed Dec. 22, 1999, the contents of which are hereby incorporated by reference. The slicers commonly include a rotatable, disc-like blade, and a reciprocating tray that brings the food product into contact with the rotating blade to cut a slice from the food product. The tray may be motor or manually driven, and typically includes a handle that provides a surface that can be gripped by a user to manually move the tray. It is often desired to remove the tray from the slicer body to clean food, fat, or other debris off of the tray. Once the tray is removed from the slicer, it is typically carried to a sink for rinsing and cleaning.

In most prior art slicers, the handle is attached to the body of the tray such that crevices or gaps may be formed between the handle and the body of the tray. In this case, food or other material may get trapped in the gaps or crevices, which can make the handle and tray time consuming to clean. Accordingly, there is a need for a slicer having a tray with a handle that eliminates any gaps or crevasses adjacent the handle, and is easier to clean.

SUMMARY OF THE INVENTION

The present invention is slicer having a tray with a unitary handle. In this manner, there are no crevices or voids between the body of the tray and the handle, and the tray is easier to clean. The unitary nature of the handle also improves the strength of the attachment of the handle to the tray.

In a preferred embodiment, the present invention is a slicer comprising a slicer body including a rotatable blade for slicing a product, and a tray mounted for reciprocal movement relative the slicer body and for supporting and moving the product relative the blade. The tray includes a tray body and a unitary handle. In another embodiment, the invention is a slicer including a slicer body having a rotatable blade for slicing a product and a tray for supporting the product and moving the product relative the blade. The slicer further includes a handle unitary with the tray, the handle providing a surface which a user may grip to manually move the tray.

Other objects and advantages of the present invention will be apparent from the following description and the accompanying drawings.

DETAILED DESCRIPTION

Figure 1:
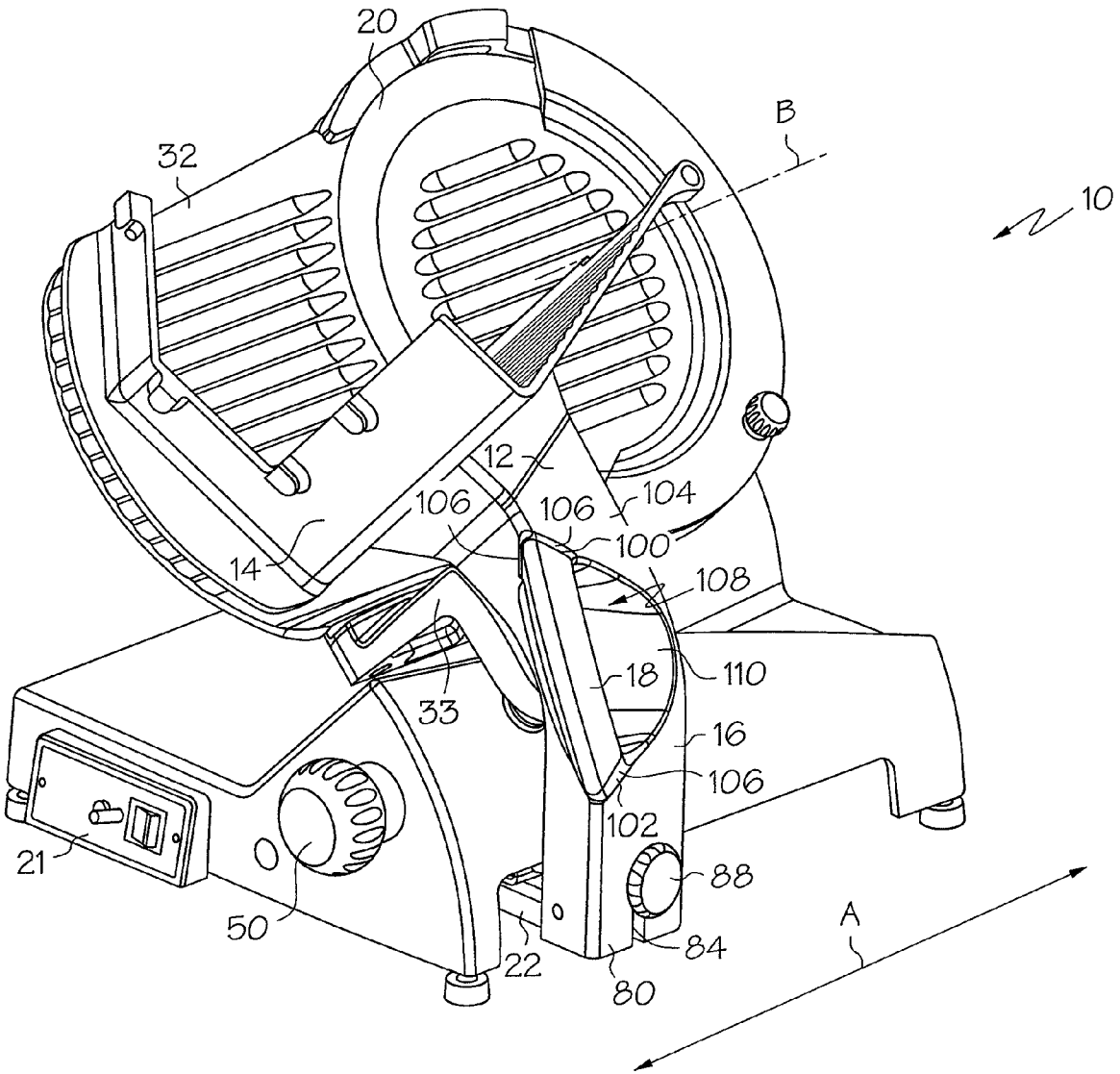
FIG. 1 is a perspective view of one embodiment of the slicer of the present invention, with the tray being located in the home position.

A slicer 10 having a tray 12 with a "V"-shaped plate or support surface 14 to receive and a support the food product to be sliced in shown in FIG. 1. The tray 12 includes a tray arm 16, and the tray 12 is typically powered along the slicing path A by a motor (not shown). Alternately, a user may grip the handle 18 and manually move the tray arm 16 along the slicing path A. The slicer 10 also includes a rotating, circular blade 20 having a central axis B. As the tray 12 reciprocates along the slicing path A, the tray 12 brings the food product into contact with the blade 20 to cut a slice off of the food product.

The tray arm 16 is coupled to a carriage 22 that extends below the body of the slicer 10 and includes an upwardly-extending end plate 24 (See FIGS. 3–4). The carriage 22 can be driven along the slicing path A and thereby drives the tray arm 16 along the slicing path A. During operation of the slicer, the tray 12 and carriage 22 preferably begin a slicing stroke at the home position, shown in FIG. 1. When in the home position, the tray 12 and carriage 22 are located closest to the operator and controls 21, and furthest from the blade 20. The tray 12 is shown in a non-home position in FIG. 2, where the tray 12 has completed a partial slicing stroke.

The slicer 10 includes a gauge plate 32 that is movable to adjust the thickness of the slice cut by the blade 20. The gauge plate 32 supports the food product as the tray 12 is passed across the blade 20, and the gauge plate 32 is movable along a line that is parallel to the central axis B of the blade 20. The closer the gauge plate 32 is located to the plane of the blade 20, the thinner the slice cut by the slicer 10. Thus, adjusting the position of the gauge plate 32 also adjusts the thickness of the slice. The gauge plate 32 may also be moved to a fully closed position wherein the gauge plate is flush with, or extends beyond, the blade 20 to substantially cover and protect the blade 20.

Figure 10:
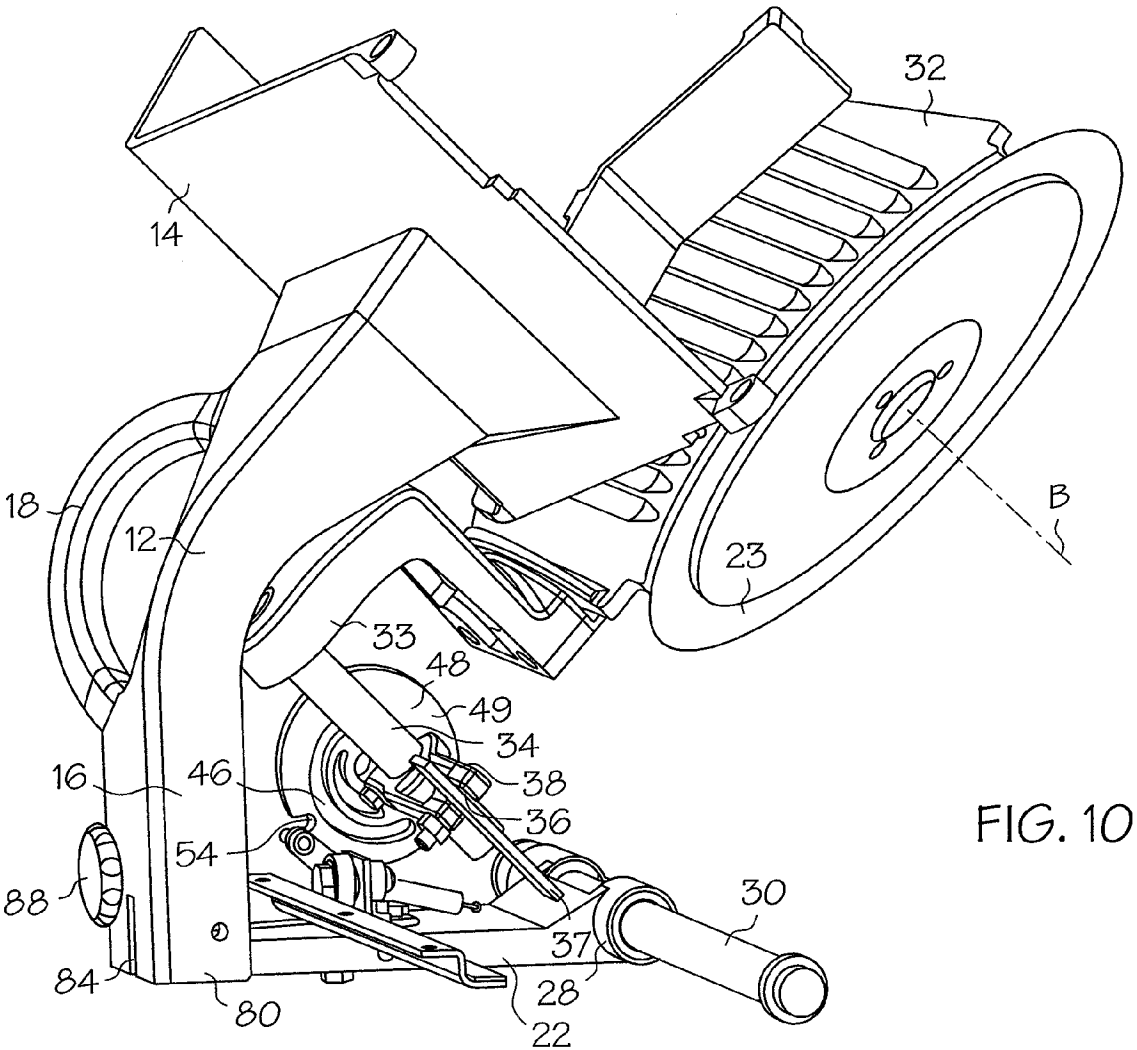
FIG. 10 is a perspective view showing various internal mechanisms of the slicer of FIG. 1.

As shown in FIG. 10, the gauge plate 32 is mounted onto a yoke 33. The yoke 33 is, in turn, coupled to a connecting rod 34 that extends generally parallel to the central axis B of the blade 20 and blade support 23. The connecting rod 34 is coupled to a transverse bar 38 that has an open end 36 and coupling pin 40 (FIG. 11) that is received in a spiral groove 46 of a gage plate cam 48. The open end 36 of the connecting rod slidingly receives a guide rail 37 therethrough. The guide rail 37 extends generally parallel to the central axis of the connecting rod 34.

Figure 11:
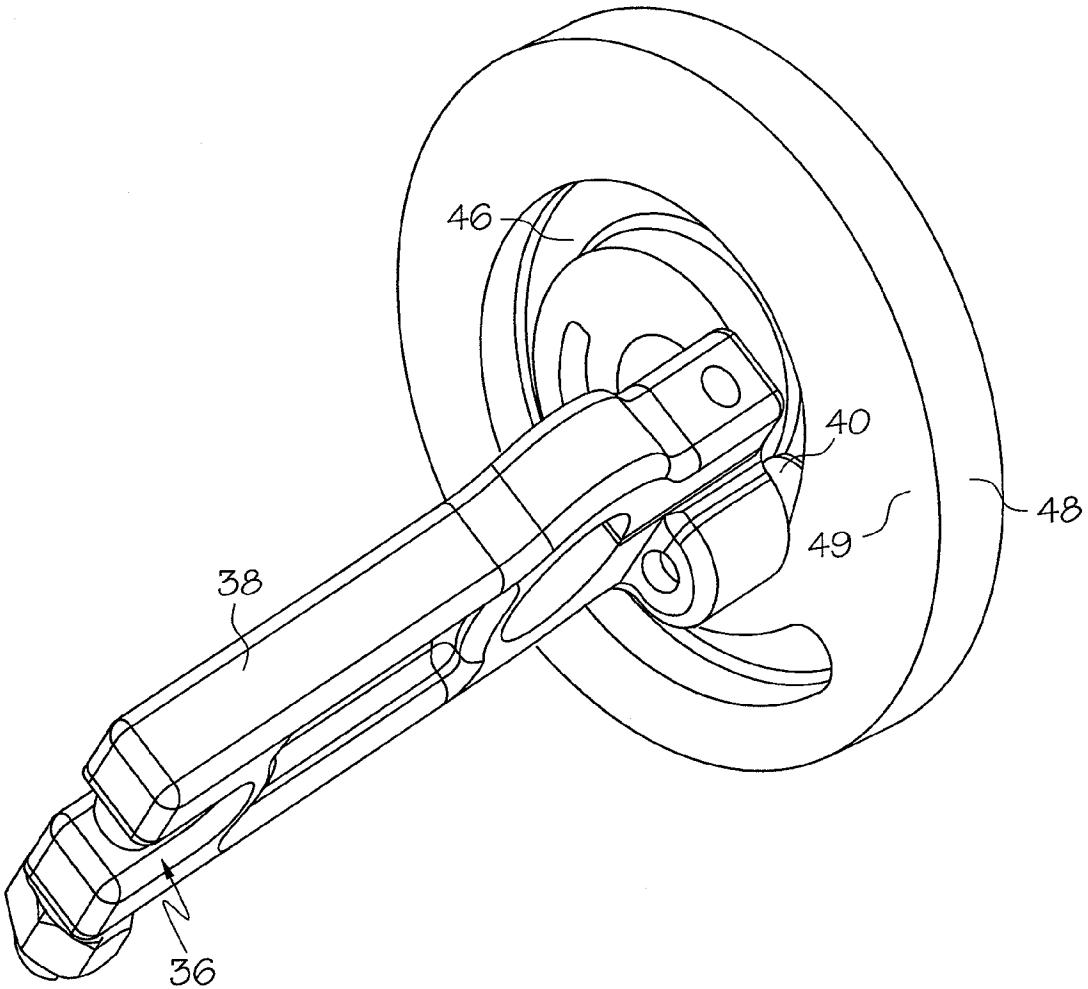
FIG. 11 is a detail perspective view showing the transverse bar and the gauge plate cam.
Figure 12:
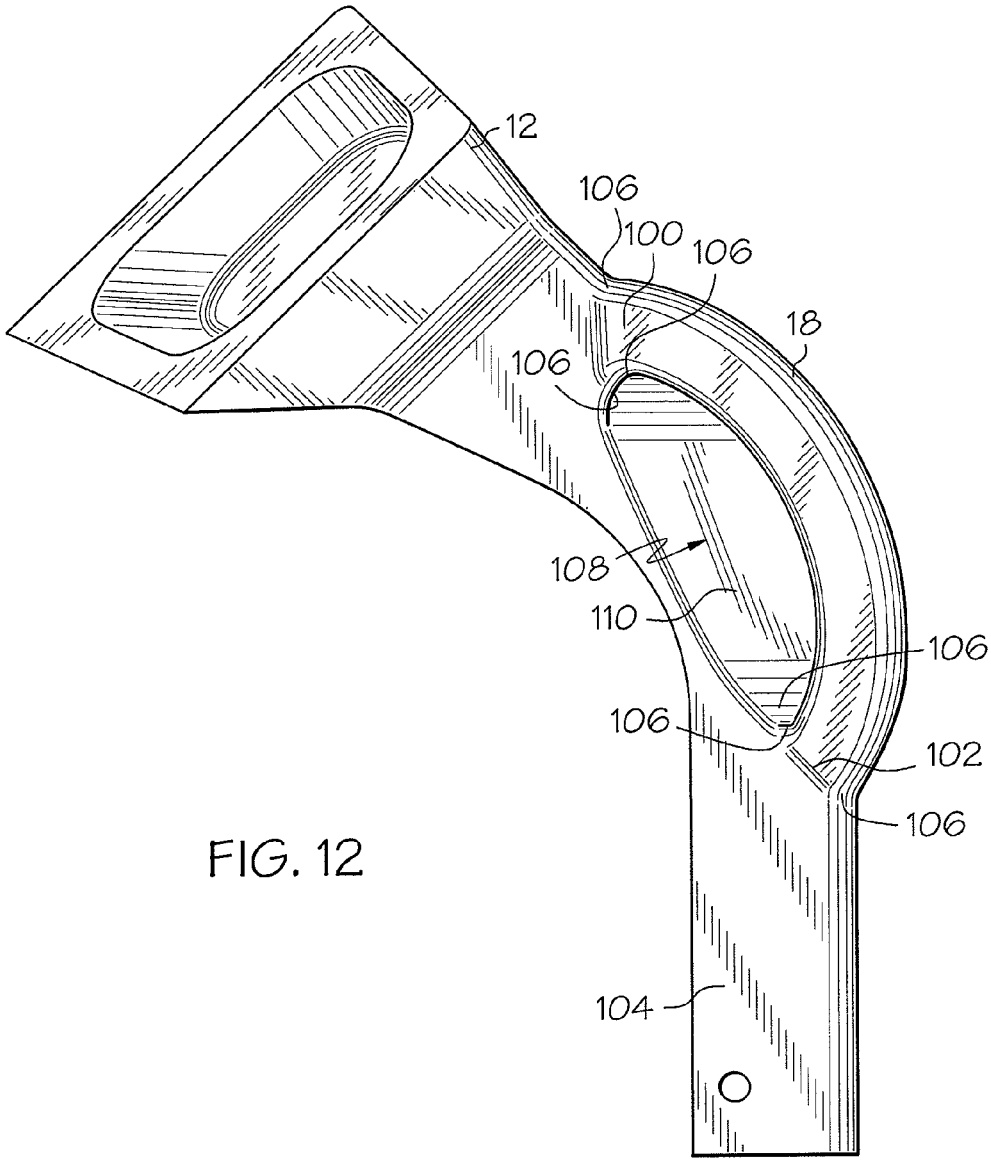
FIG. 12 is a left side view of the tray of the slicer of FIG. 1, with the support plate removed.
Figure 13:
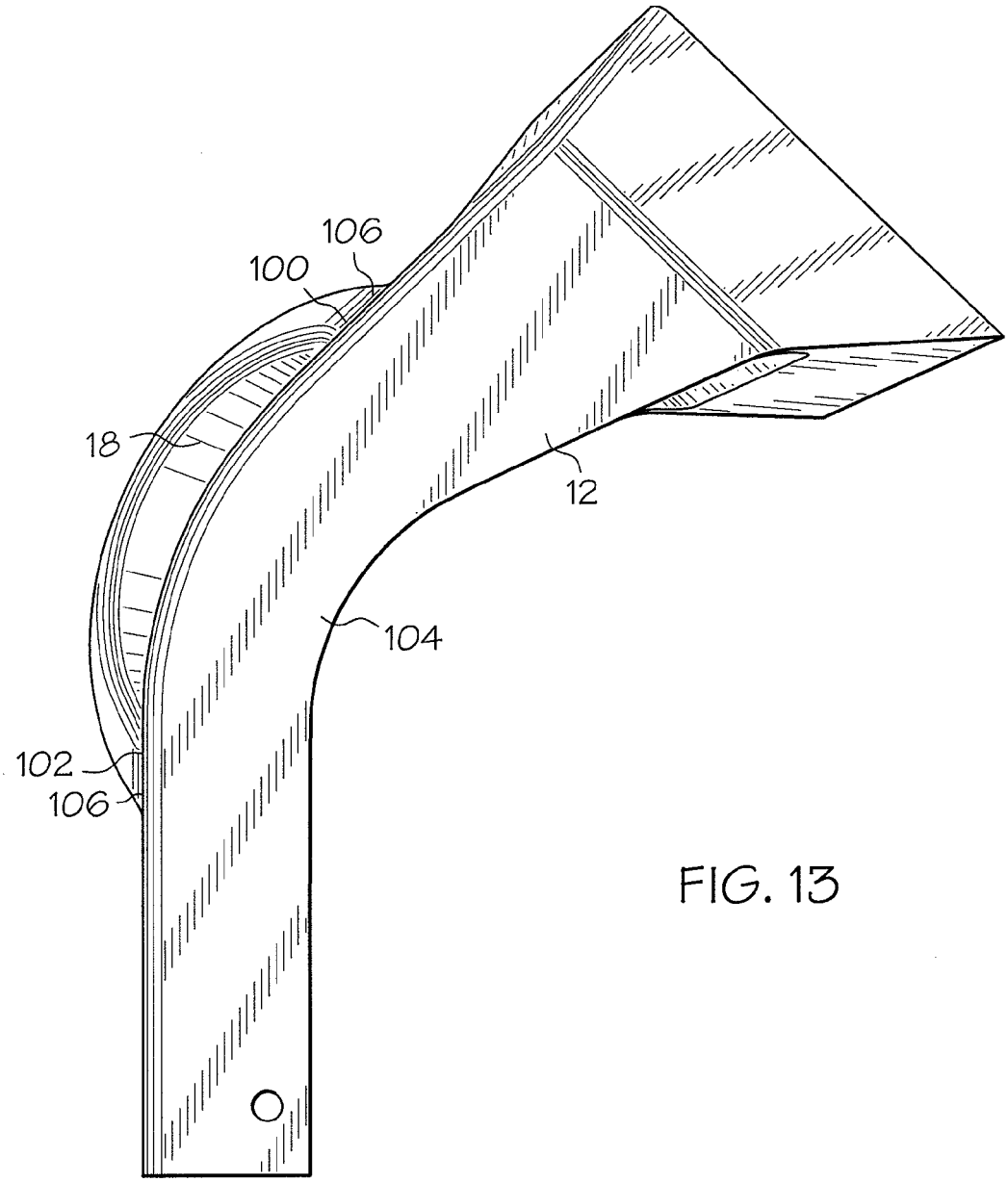
FIG. 13 is a right side view of the tray of FIG. 12.
Figure 14:
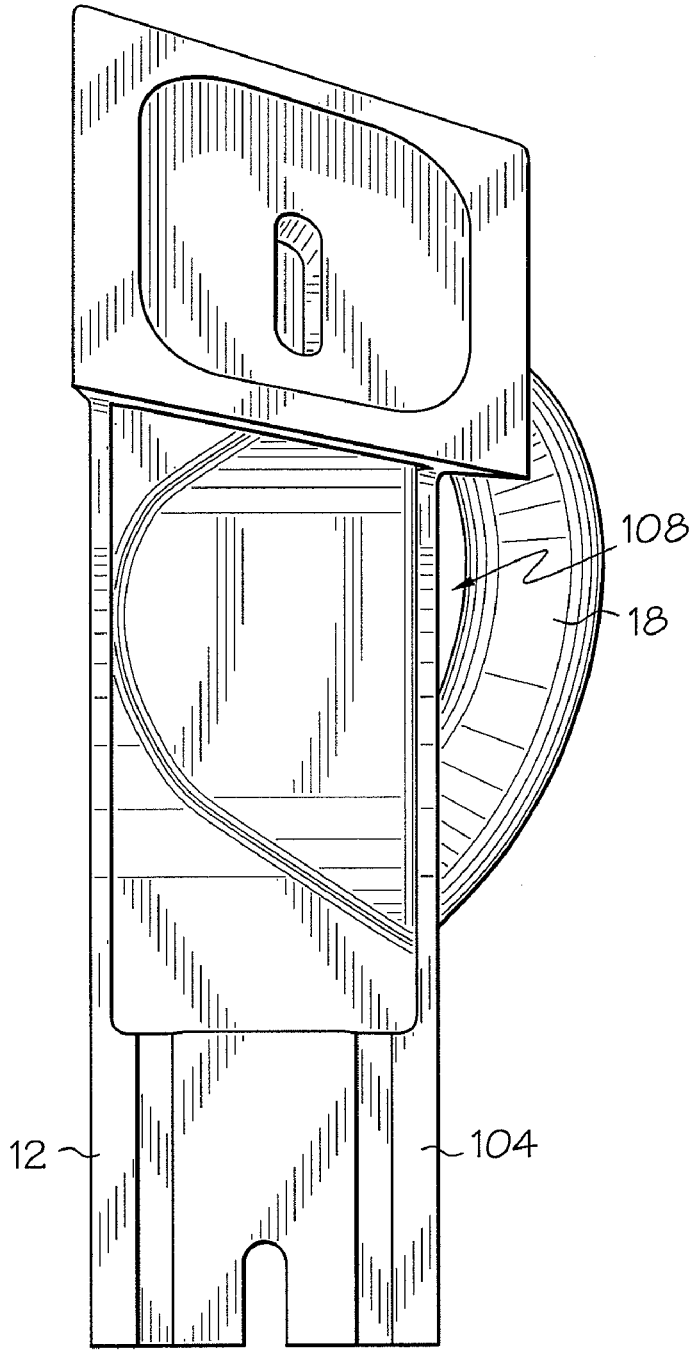
FIG. 14 is a front view of the tray of FIG. 12.
Figure 15:
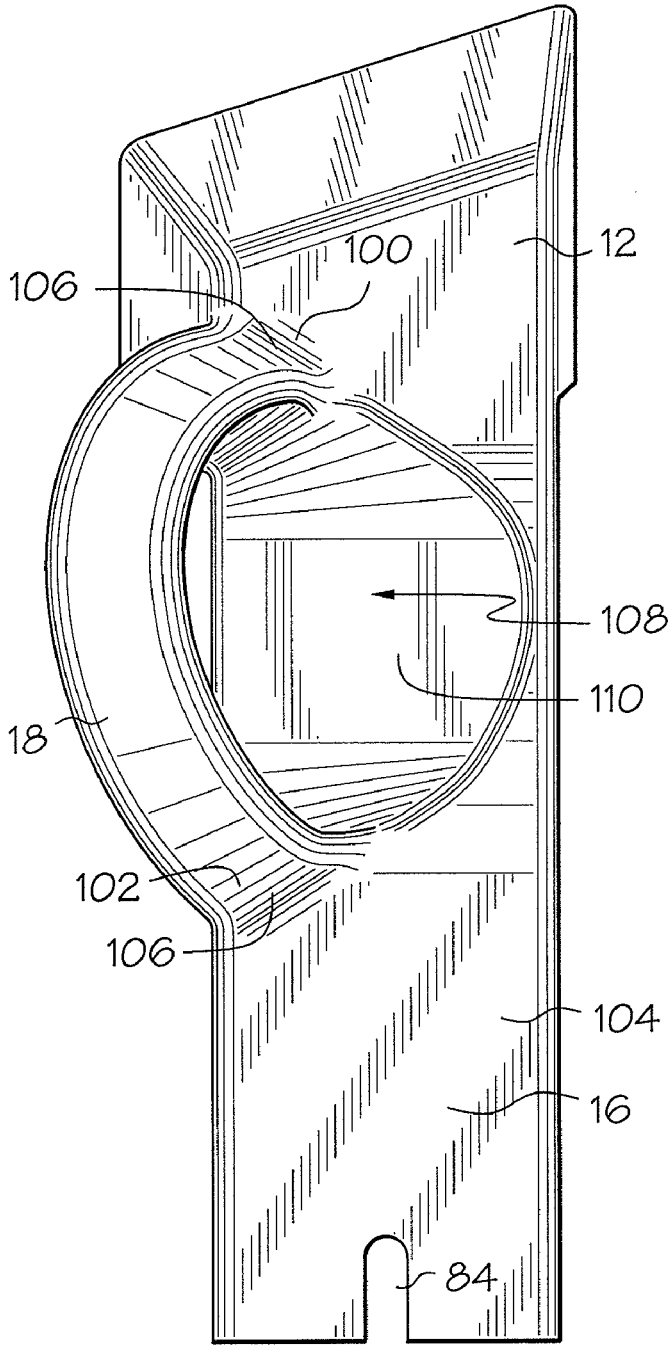
FIG. 15 is a rear view of the tray of FIG. 12.
Figure 16:
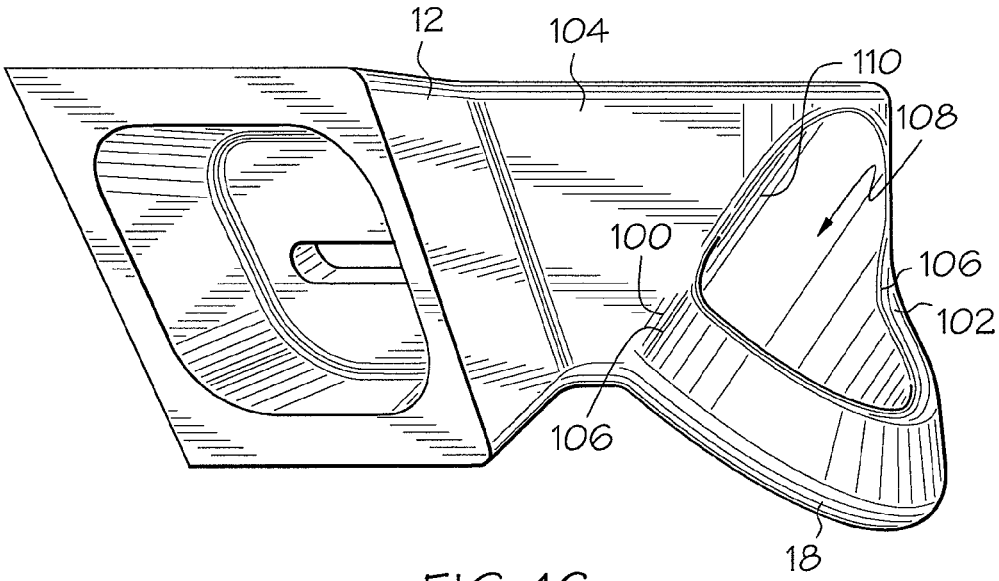
FIG. 16 is a top view of the tray of FIG. 12.
Figure 17:
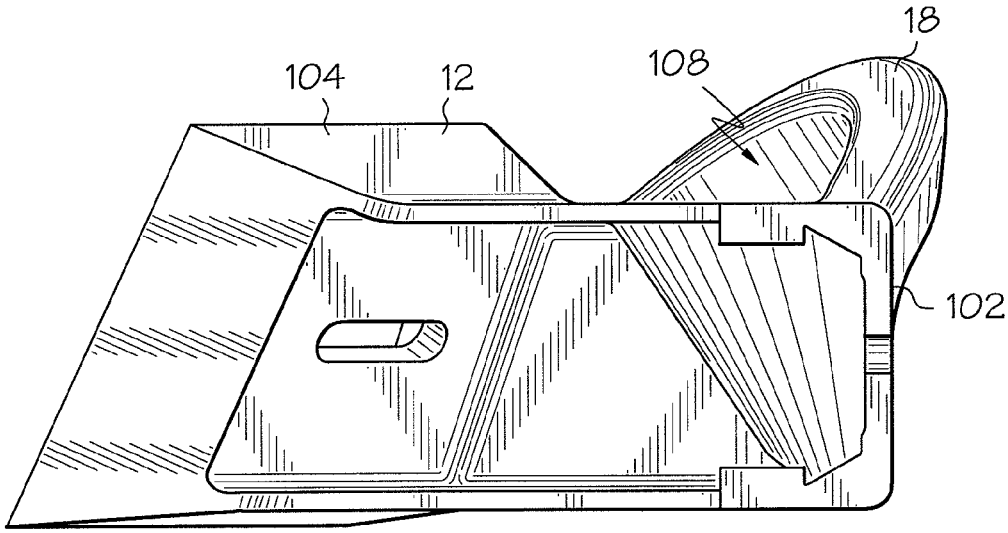
FIG. 17 is a bottom view of the tray of FIG. 12.

The slicer 10 includes a generally "wheel" shaped gauge plate cam 48 having a spiral groove 46 formed on a first side 49 of the cam, and a notch 47 (FIG. 4) on the second side 51 of the cam 48. The coupling pin 40 of the transverse bar 38 is received in the spiral groove 46 of the cam 48, as shown in FIG. 11. The gauge plate cam 48 is coupled to a gauge plate knob 50 (FIG. 1) such that manual rotation of the gauge plate knob 50 causes rotation of the gauge plate cam 48.

When a user desires to adjust the position of the gauge plate 32 to vary the thickness of a slice cut by the slicer 10, the user manually rotates the gauge plate knob 50 which rotates the gauge plate cam 48. As the gauge plate cam 48 rotates, the coupling pin 40 slides within the spiral groove 46, which urges the coupling pin 40 and the transverse bar 38 either closer to, or further away from, the slide rod 30 along the direction of the axis B. This in turn moves the connecting rod 34 along its central axis, and adjusts the position of the yoke 33 and gauge plate 32 along the axis B (FIG. 10). Thus, rotation of the gauge plate knob 50 and gauge plate cam 48 causes the gauge plate 32 to move closer to, or further away from, the blade 20. It should be understood that this mechanism for varying the position of the gauge plate 32 is merely one of many mechanisms that may be used to adjust the gauge plate, and nearly any mechanism for adjusting the gauge plate 32 may be used with the interlock shown herein.

Figure 3A:
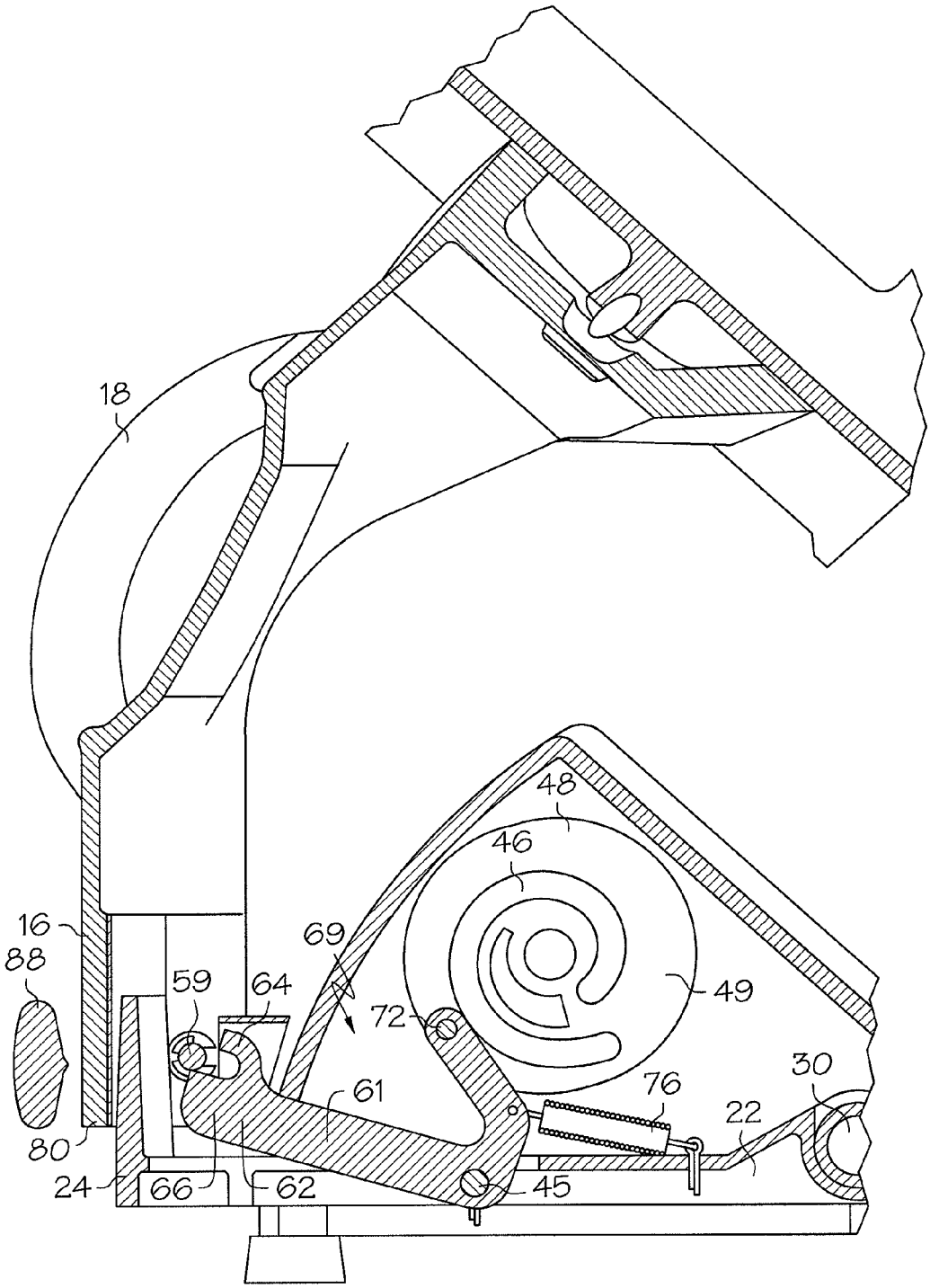
FIG. 3A is a side, cross section view of the slicer of FIG. 1, with the locking arm in its release position.
Figure 3B:
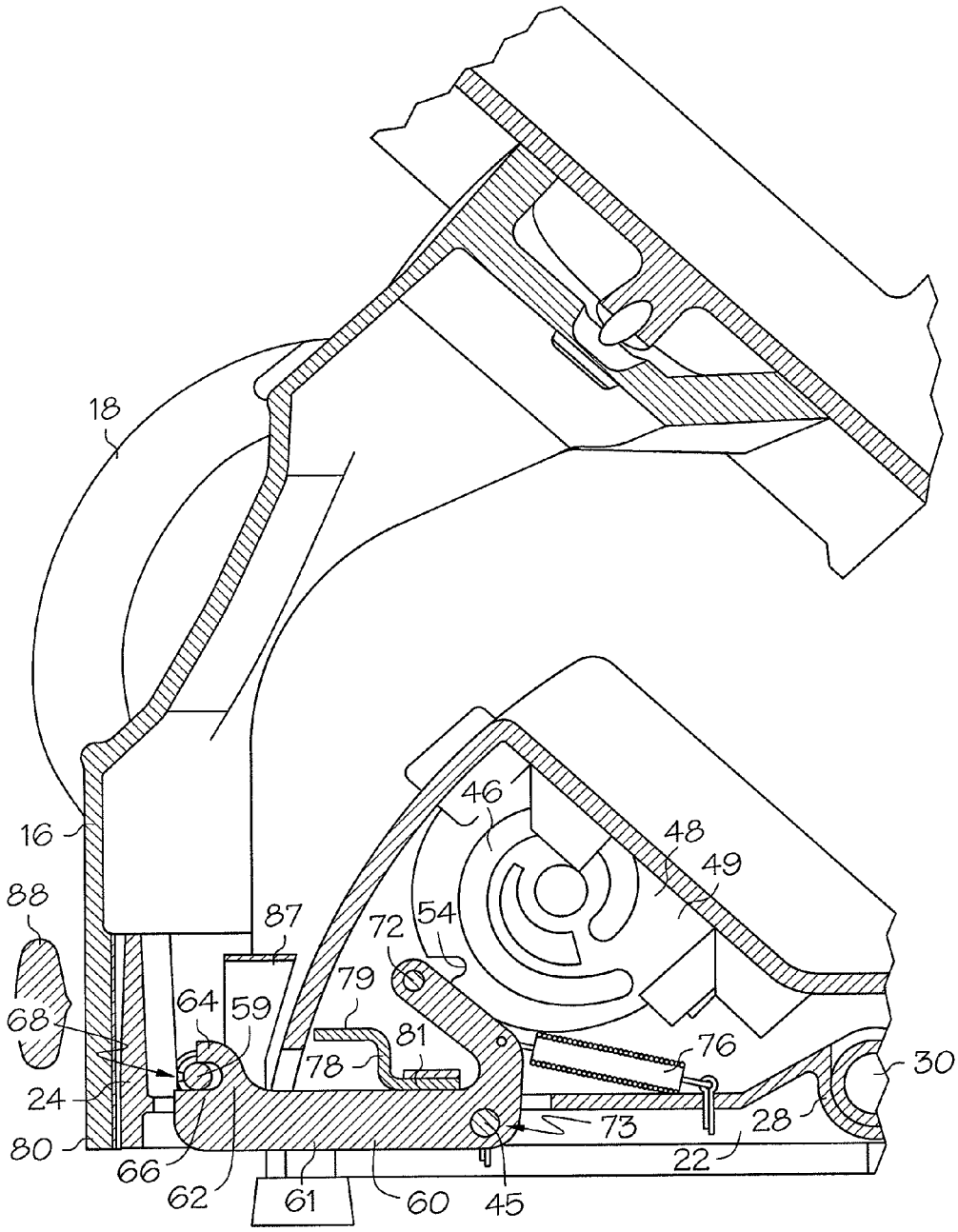
FIG. 3B is a side, cross section view of the slicer of FIG. 3A, with the locking arm in its locking position and the tray arm retained in the locking arm.
Figure 4:
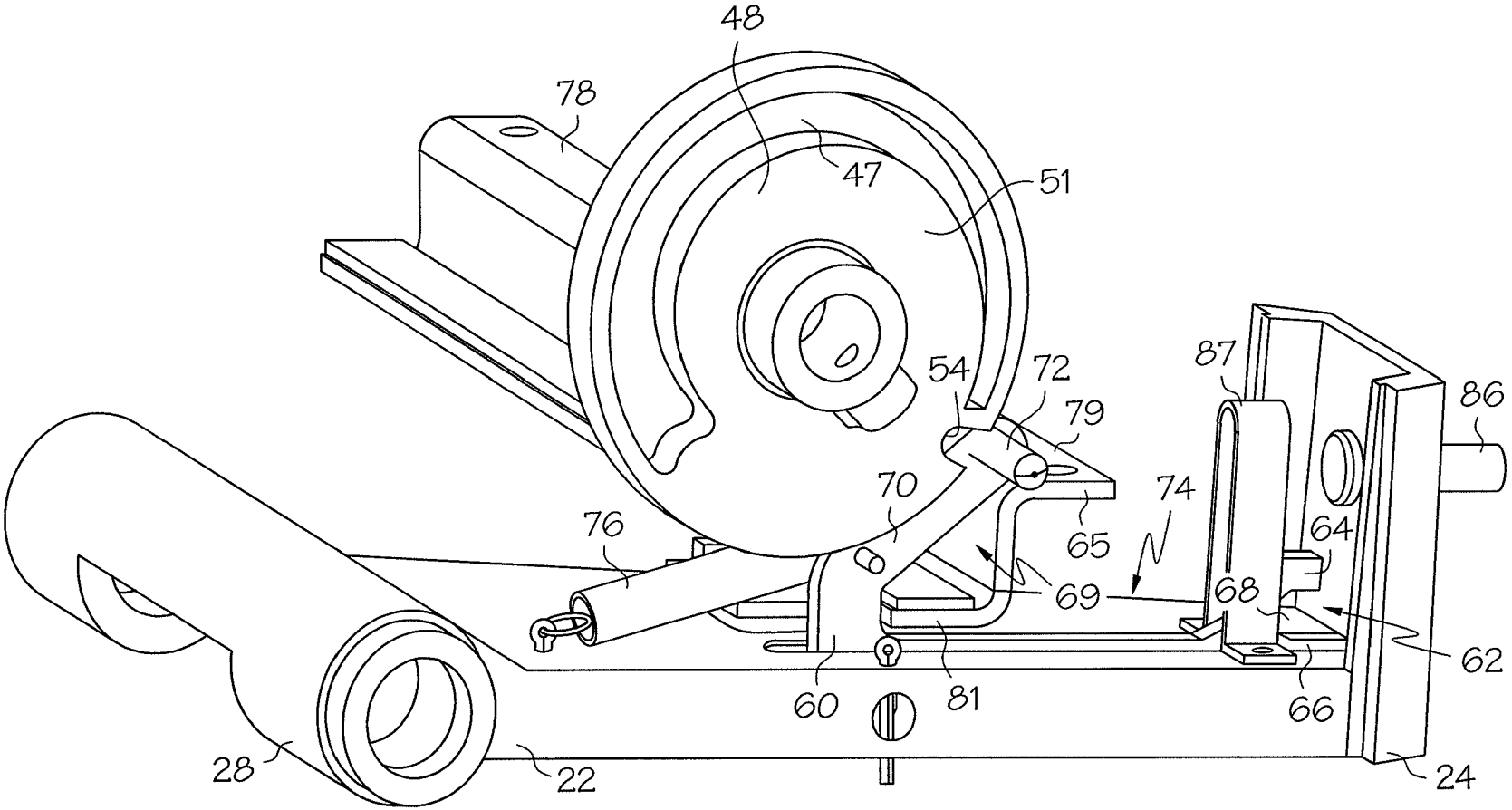
FIG. 4 is a perspective view of the carriage, gauge plate cam and hold-down bar of the slicer of FIG. 1, with the locking arm in its locking position.
Figure 5:
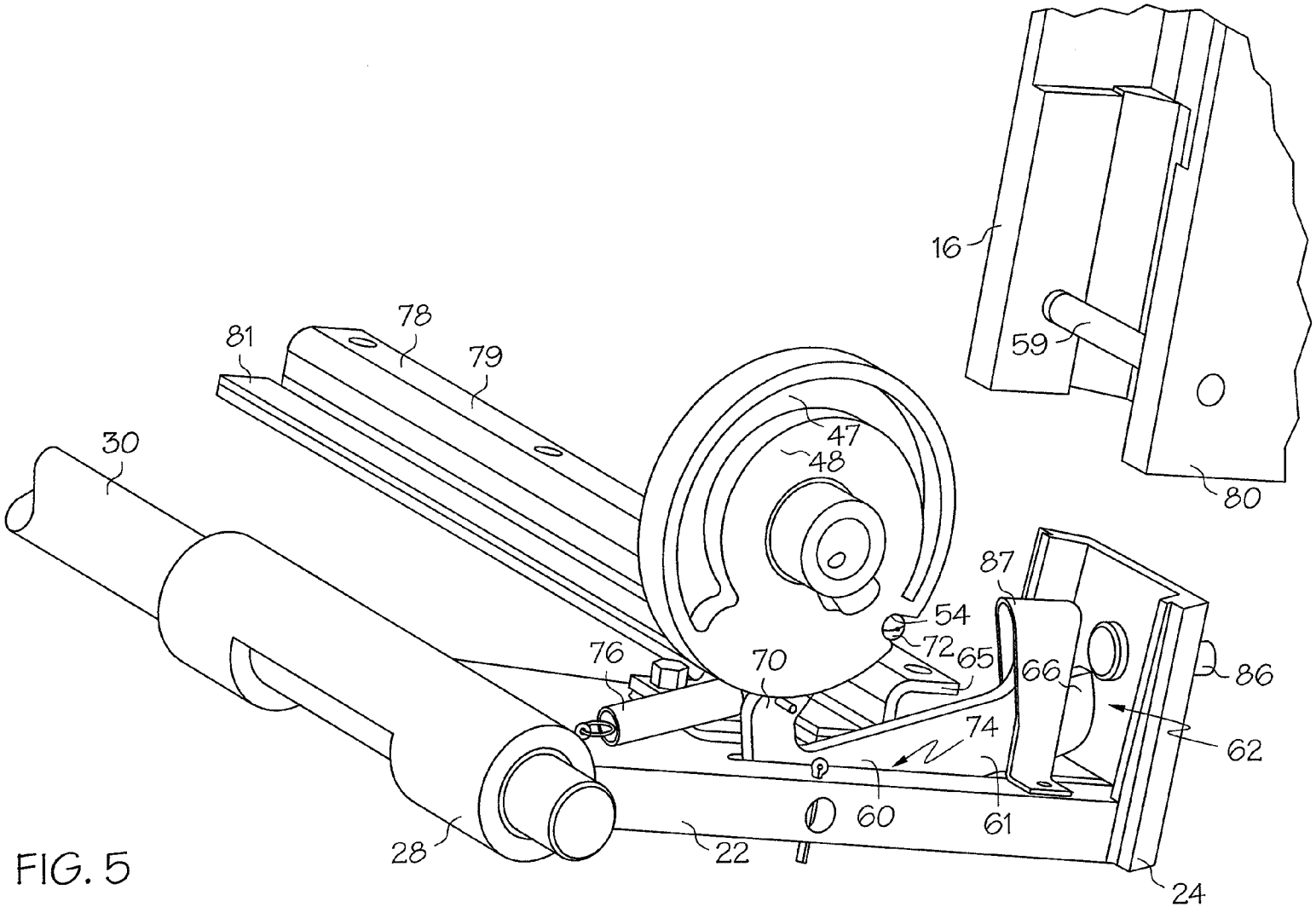
FIG. 5 is a perspective view of the carriage, gauge plate cam and hold-down bar of FIG. 4, along with part of the slicer arm, with the locking arm in its release position.

The mechanism for attaching the carriage 22 to the tray arm 16 is shown in greater detail in FIGS. 3–5. The lower end of the tray arm 16 is generally "U" shaped in cross section (FIG. 5), and includes an outer body 80 and a cross bar 59. The carriage 22 includes a bushing 28 that receives a guide rod 30 to guide the reciprocation of the carriage 22. The carriage 22 includes a locking arm 60 for coupling the tray arm 16 to the carriage 22, and the locking arm is pivotably coupled to the carriage 22 by pin 45 (FIG. 3A).

Figure 8:
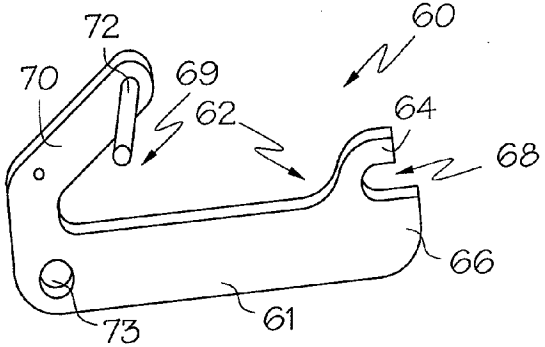
FIG. 8 is a perspective view of the locking arm.

The locking arm 60 is generally "U"-shaped in side view as shown in FIG. 8. The locking arm 60 includes a lower portion 61 that terminates in an open end 62. The open end 62 includes an upper flange 64, a lower flange 66, and a notch 68 located between the upper 64 and lower 66 flanges. The locking arm 60 also includes an upper portion 70 that includes a transverse pin 72. The locking arm 60 has a lower hole 73, and the arm 60 is pivotably attached to the carriage 22 by a pin 45 received through the lower hole 73 (see FIG. 3B). The locking arm 60 is received in a groove 74 formed in the carriage (FIG. 4), and the locking arm 60 is pivotable about the pin 45 between a locking position (FIG. 4) and a release position (FIG. 5). A spring 76 extends between the locking arm 60 and the carriage 22 to bias the locking arm 60 in the release position. When the locking arm 60 is in its release position, the tray arm 16 may be placed into, and removed from, the locking arm 60. Also, when the locking arm is in its release position, the transverse pin 72 of the locking arm 60 is received into the groove 54 of the gauge plate cam 48, which prevents any rotation of the gauge plate cam 48. In this manner, when the locking arm 60 is in its release position, a user is blocked from rotating the gauge plate cam 48, which blocks the user from adjusting the position of the gauge plate 32.

In order to attach the tray arm 16 to the carriage 22, the tray arm 16 is positioned over the upstanding end wall 24 of the carriage 22, as shown in FIG. 5. The locking arm 60 is automatically located in its release position as biased by the spring 76. The tray arm 16 is lowered over the carriage 22 such that the outer body 80 of the tray arm 16 slides around the upstanding end wall 24 of the carriage 22. The cross bar 59 of the tray arm is shaped and located to be received in the notch 68 of the open end 62 of the locking arm 60 (FIG. 8). As the tray arm 16 is lowered, the cross bar 59 is received in the notch 68 of the locking arm 60 and the cross bar 59 engages the lower flange 66 of the locking arm 60. The cross bar 59 then urges the locking arm 60 to pivot about the pin 45 to its locking position. FIG. 3B illustrates the locking arm 60 in its locking position with the cross bar 59 of the tray arm 16 received in the notch 68 of the locking arm.

As the locking arm 60 is moved into the locking position, the transverse pin 72 of the locking arm 60 is pulled out of the notch 54 in the gauge plate cam 48, as can be seen in FIG. 3B. Thus, once the locking arm 60 is in the locking position, the gauge plate cam 48 is free to rotate, and the user can adjust the position of the gauge plate 32.

Figure 2:
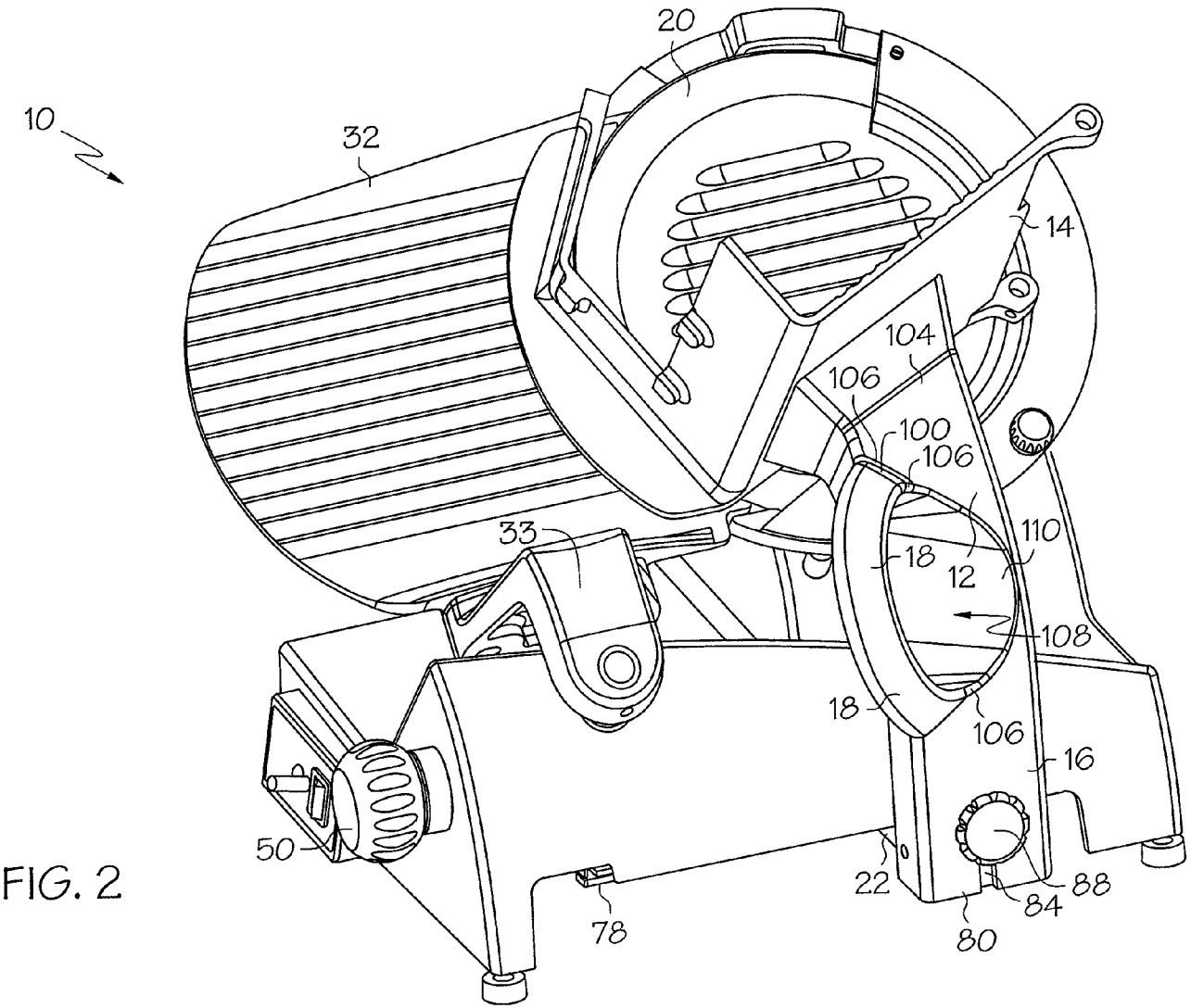
FIG. 2 is a perspective view of the slicer of FIG. 1, with the tray in a non-home position.

The tray arm 16 also includes a vertically-extending slot 84 on its outer body 80 (See FIGS. 1–2). The slot 84 must be aligned with a threaded post or bolt 86 (FIG. 4) that extends forwardly from the upstanding end 24 wall of the carriage 22 when the tray arm 16 is lowered over the upstanding end wall 24. A nut 88 is threaded onto the threaded post 86, and spaced away from the upstanding end wall 29 to enable the tray arm 16 to be received between the nut 88 and the upstanding end wall 24. Once the tray arm 16 is mounted onto the carriage 22 and the locking arm 60 is moved to its locking position, the nut 88 may be tightened down to engage the outer body 80 and lock the tray 12 to the carriage 22.

Once the tray arm 16 is received in the locking arm 60 and the locking arm 60 is moved to its locking position, the slicer 10 may be moved out of its home position, and operated such that the tray 12 and carriage 22 reciprocate along the slicing path A. The slicer includes a retaining bar or track 78 that extends along the majority of the slicing path A, and the retaining bar 78 includes an upper portion 79 and a lower portion 81. The carriage 22 includes a roller 83 (FIG. 9) that rolls on top of the lower portion 81 to help guide the reciprocation of the carriage 22 along the slicing path A, and the roller 83 is coupled to the carriage 22 by a bracket 85.

Figure 7:
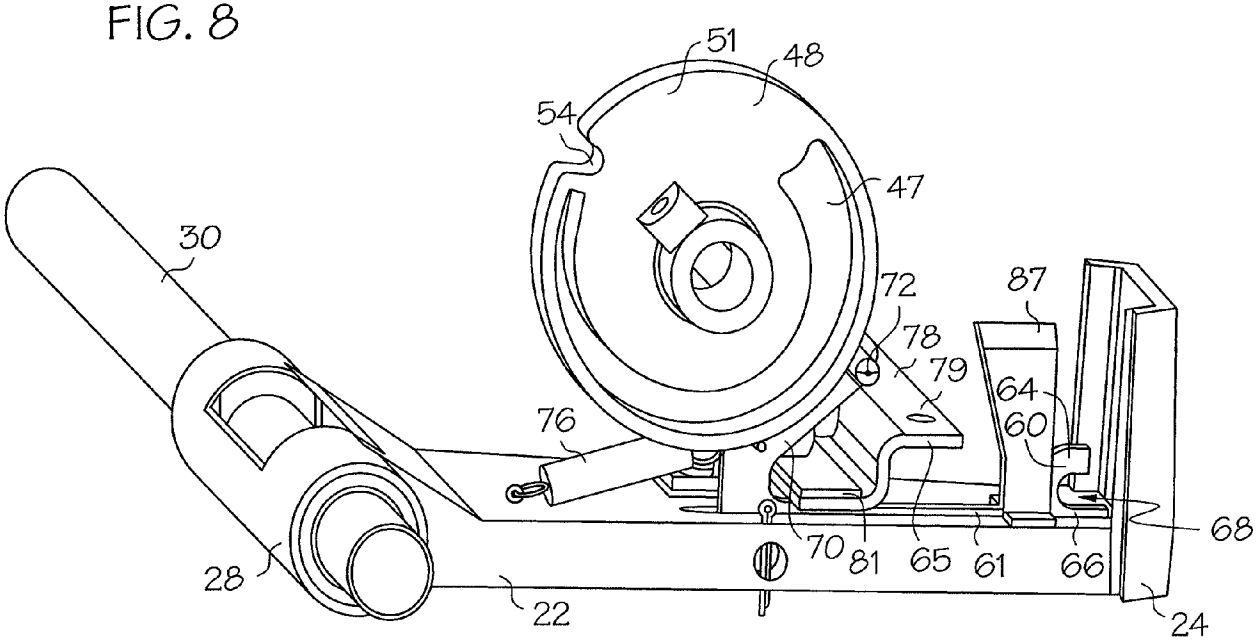
FIG. 7 is a perspective view of the carriage, gauge plate cam and hold-down bar of FIG. 6, with the carriage in a non-home position.
Figure 9:
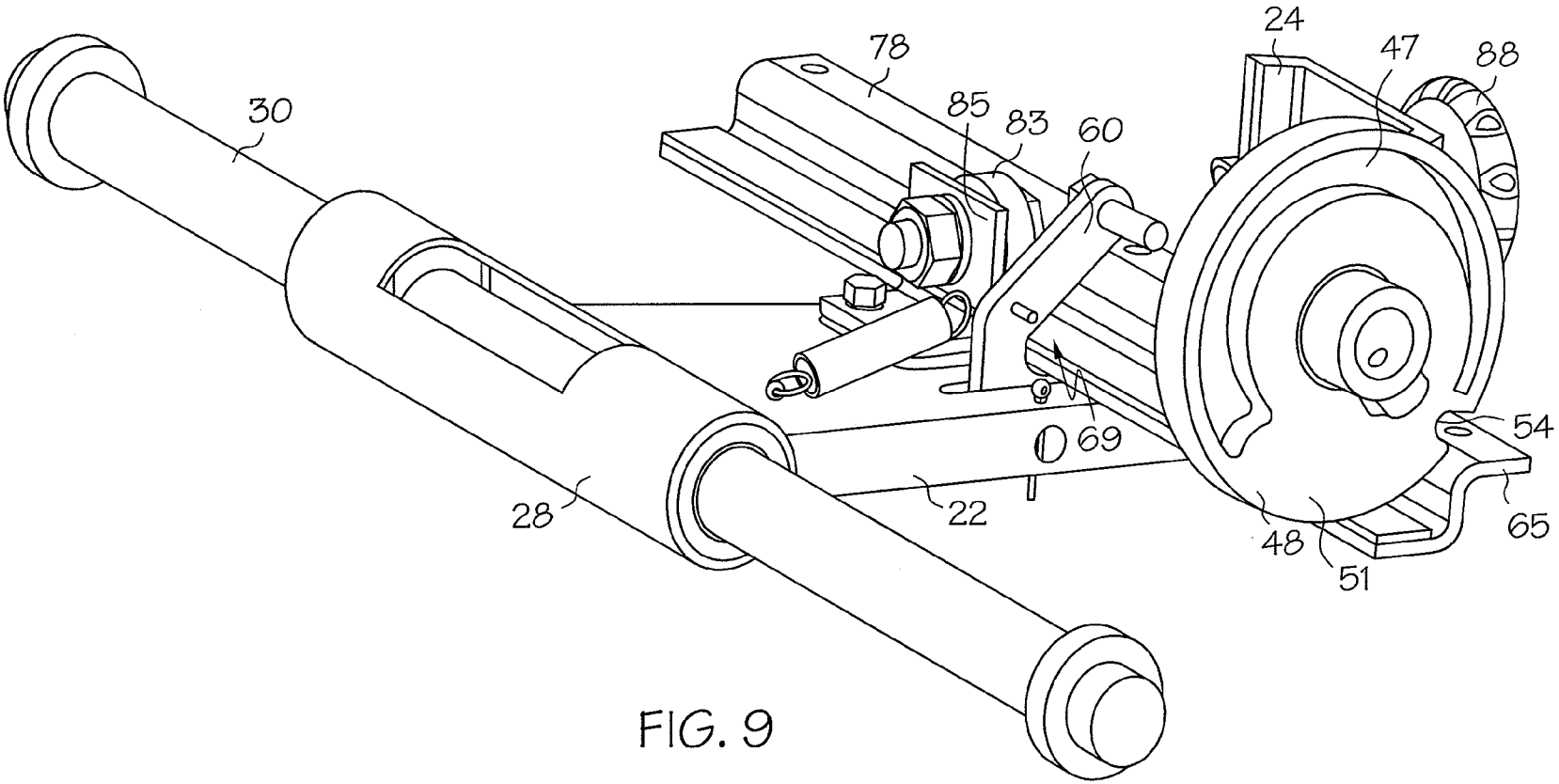
FIG. 9 is a perspective view of the carriage, gauge plate cam and hold-down bar of FIG. 6, with the carriage in a non-home position.

As shown in FIGS. 4–5, when the tray 12 is in the home position, the retaining bar 78 is not located above lower portion 61 of the locking arm 60. However, as shown in FIGS. 7 and 9, when the tray 16 is in a non-home position, the retaining bar 78 is located immediately above the lower portion 61 of the locking arm 60. FIG. 7 illustrates the position of the carriage 22 when the carriage has just moved from the home position, and FIG. 9 illustrates the position of the carriage 22 when the carriage has completed about half of a slicing stroke. In these non-home positions, the retaining bar 78 is received in a central gap 69 of the locking arm 60.

Thus, when the tray 16 is in a non-home position, the retaining bar 78 blocks the locking arm 60 from moving to its release position. If the tray 12 were to be attempted to be lifted off of the carriage 22 when the tray 12 is not in the home position, the cross bar 59 of the tray arm 16 would engage the top flange 64 of the locking arm and attempt to pivot the locking arm 60 to its release position. However, the lower portion 81 of the retaining bar 78 would block the locking arm 60 from pivoting, and thereby block the locking arm 60 from moving to its release position. Thus when the locking arm 60 is in its locking position and the tray 12 is in a non-home position, the tray arm 16 is locked into place in the locking arm 60 and cannot be removed from or placed into the locking arm 60.

During normal operating conditions, the carriage 22 and tray 12 reciprocate along the slicing path A to cut slices off of the food product. The gauge plate knob 50 may be adjusted to vary the thickness of the slices. The locking arm 60 retains the cross bar 59 of the tray arm 16 in the notch 68 of the locking arm, and the locking arm is maintained in its locking position by the retaining bar 78. However, the tray 12 and tray arm 16 must be periodically removed from the slicer in order to clean or service the tray arm 16. The interlock mechanism prevents the tray 12 from being removed from the slicer 10 except when certain conditions are met.

Figure 6:
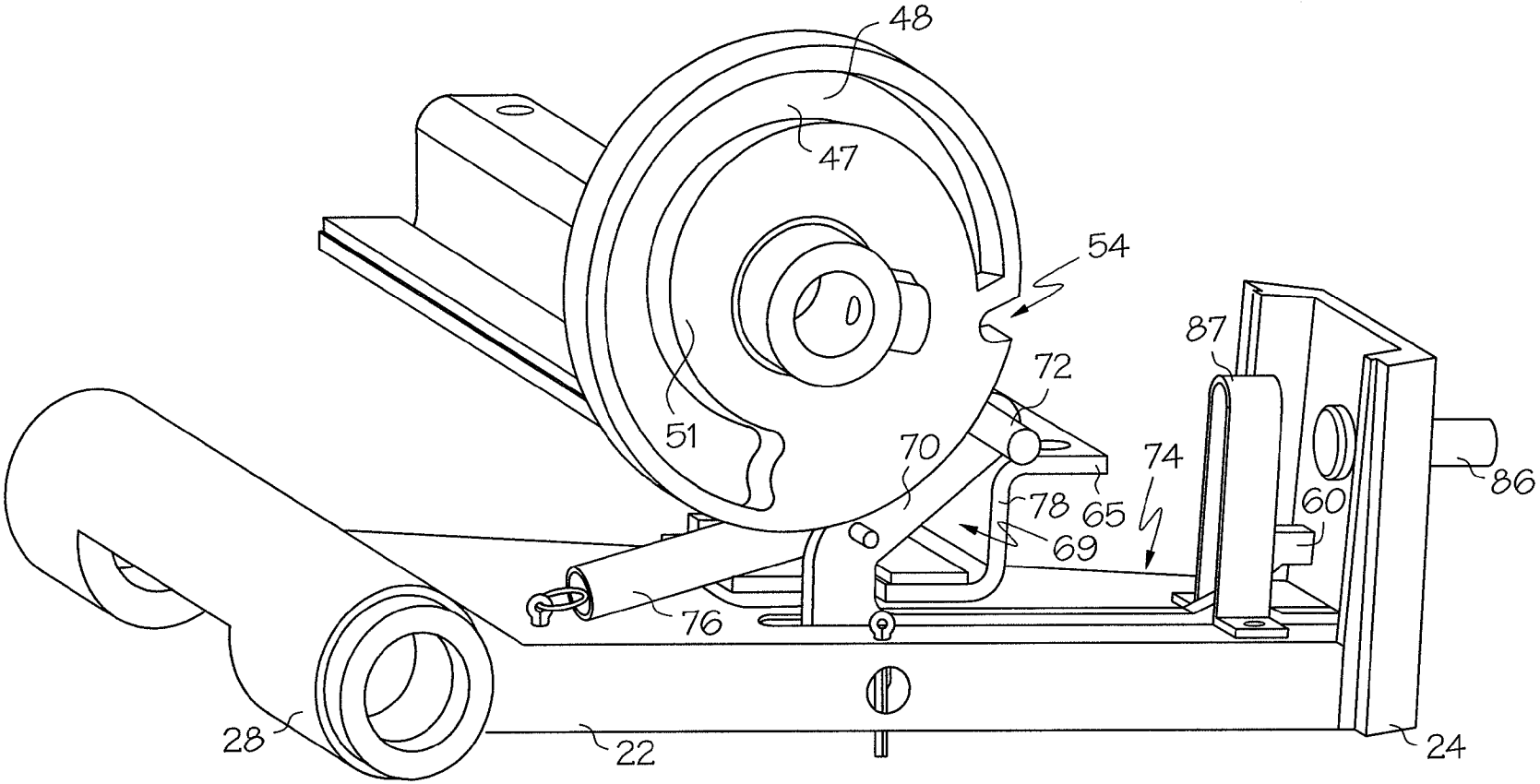
FIG. 6 is a perspective view of the carriage, gauge plate cam and hold-down bar of FIG. 4, with the gauge plate cam rotated from its position shown in FIG. 4.

In order to uncouple the tray 12 from the slicer 10, the tray 12 must first be moved to the home position. The tray 12 and carriage 22 are shown in the home position in FIG. 6. When the tray 12 is in its home position, the retaining bar 78 is not located above the locking arm 60, and therefore retaining bar 78 does not block the locking arm from moving to its release position. However, if locking arm 60 were attempted to be moved to its release position, the gauge plate cam 48 would block the locking arm from moving to its release position. More specifically, when the gauge plate cam 48 is in the configuration shown in FIG. 6, if locking arm 60 were attempted to be moved to its release position, the transverse pin 72 would engage the outer surface of the cam 48, which would block the locking arm 60 from pivoting to its release position.

In order for the locking arm 60 to pivot to its release position, the transverse pin 72 must be aligned with the notch 54 in the gauge plate cam 48. In order to align the notch 54 with the transverse pin 72, the gauge plate cam 48 is rotated by the knob 50 until the gauge plate cam 48 is in the position shown in FIG. 4. When the slicer is in this configuration, the transverse pin 72 can be received in the notch 54, which enables the locking arm 60 to move to its release position, as shown in FIG. 5. Once the locking arm 60 is in its release position, the tray arm 16 may be uncoupled from the carriage 22. The gauge plate cam 48 is preferably calibrated such that the gauge plate 32 is located in its fully closed position when the notch 54 of the gauge plate cam 48 is aligned with the transverse pin 72 of the locking arm 60. This ensures that the blade 20 is somewhat protected by the gauge plate 32 before the tray arm 16 can be removed.

Accordingly, the interlock mechanism ensures that two conditions must be met before the tray 12 can be uncoupled from the carriage 22: (1) the tray 12 and carriage 22 must be located in their home position; and (2) the gauge plate 32 must be located in its fully closed position. Once both these requirements are met, the nut 88 can be loosened and moved away from the tray arm 16, and the tray arm may then be lifted vertically off of the carriage 22 (FIG. 5). When the tray 12 is lifted off the carriage 22, the locking arm 60 is moved to its release position as biased by the spring 76, and remains in that position until the tray 12 is replaced in the locking arm 60.

The tray 12 may then be carried to a sink for cleaning or maintenance. The only component of the interlock mechanism located on the tray 12 is the cross bar 59. In this manner, the number of parts of the interlock mechanism on the tray 12 is minimized, which minimizes the exposure of the parts of the interlock mechanism to water and detergents when the tray 12 is washed. Furthermore, the cross bar 59 is protected on three sides by the outer body 80, which protects the retaining bar from external forces.

When the tray 12 is uncoupled from the carriage 22, the locking arm 60 is in its position shown in FIG. 5. When in this position, the transverse pin 72 of the locking arm 60 is received in the notch 54 of the gauge plate cam 48. Thus, when the tray arm 16 is uncoupled from the carriage 22 the gauge plate cannot be adjusted. Furthermore, the locking arm 60 prevent the carriage 22 from moving away from the home position when the tray 12 is uncoupled from the carriage 22. If the carriage 22 were attempted to be moved along the slicing path A, the locking arm 60 would engage the end surface 65 of the retaining bar 78, which would block the attempted movement of the carriage along the slicing path. A cover 87 is located over the locking arm to prevent inadvertent movement of the locking arm to the release position when the tray 12 is removed.

After the tray 12 is cleaned or serviced, it may be coupled to the carriage 22. In order to attach the tray 12 to the carriage 22, the tray arm 16 is positioned over the upstanding end wall 24 of the carriage 22, as shown in FIG. 5. The tray arm 16 is lowered over the carriage 22 such that the outer body 80 of the tray arm 16 slides around the upstanding end wall 24 of the carriage 22. The cross bar 59 of the tray arm is received in the notch 68 of the open end 62 of the locking arm 60. As the tray arm 16 is lowered, the cross bar 59 urges the locking arm 60 to pivot to its locking position (FIG. 3B).

When the tray 12 is coupled to the carriage 22, the locking arm 60 is pivoted into its locking position (as urged by the cross bar 59). Thus, the transverse pin 72 of the locking arm 60 is pulled out of the notch 54 in the gauge plate cam 48, which enables the gauge plate cam 48 to be rotated and the position of the gauge plate 32 to be adjusted. Furthermore, when the locking arm 60 is in its locking position, lower portion 61 of the lower arm is located below the lower portion 81 of the retaining bar, which enables the carriage 22 and tray to move along the slicing path A without engaging the end surface 65 of the cross bar 78. Thus, after the tray 12 is mounted onto the carriage 22, the gauge plate 32 may be adjusted to achieve the desired thickness of slices, the slicer 10 may be activated and slicing operations commenced. The carriage 22 and tray 12 then reciprocate along the slicing path A to slice the food product received in the tray 12.

If an interlock mechanism is not desired in the slicer, the assembly of the slicer described herein can be easily modified to produce a slicer lacking an interlock. For example, the locking arm 60, spring 76 and cover 87 may not be mounted onto the slicer if an interlock is not desired. The carriage 22, gauge plate cam 48 and other components need not be changed. Thus, most of the parts in a slicer lacking an interlock are the same as the parts of a slicer having an interlock, which reduces assembly costs.

As shown in FIGS. 1, 2, 10 and 12–18, the handle 18 is preferably integrally or unitarily formed with the body 104 of the tray 12. In this manner, there are no gaps or openings located between the attachment points 100, 102 of the handle 18 and the body of the tray 104, which prevents food or other matter from getting trapped between the handle 18 and the body of the tray. The tray 12 preferably includes curved surfaces 106 at the attachment points 100, 102 that form a smooth transition between the handle 18 and the body 104 of the tray 12. The curved surfaces 106 help to make the tray 12 easy to clean, as the curved surfaces 106 eliminate any corners that may trap food or other material.

The handle 18 is preferably attached to the body of the tray 12 at two attachment points 100, 102, and extends generally vertically. In this manner, the handle 18 and the body of the tray 104 form an opening 108. A user may extend his or her fingers or hand through the opening 108 such that the handle 18 can be easily gripped in the user's palm for moving the tray 12 along the slicing path. The handle 18 is preferably generally arcuate in side view; that is, the handle extends between the attachment points 100, 102 in a generally arcuate shape. The tray body 104 also preferably includes a recessed area 110 located between the attachment points 100, 102 to increase the effective size of the opening 108, which makes it easier for a user to fit his or her hand through the opening 108. As shown in FIG. 1, the handle 18 extends generally away from the tray body 104 towards the home position. In this manner, the handle 18 in angled towards the expected location of the user or operator.

Figure 18:
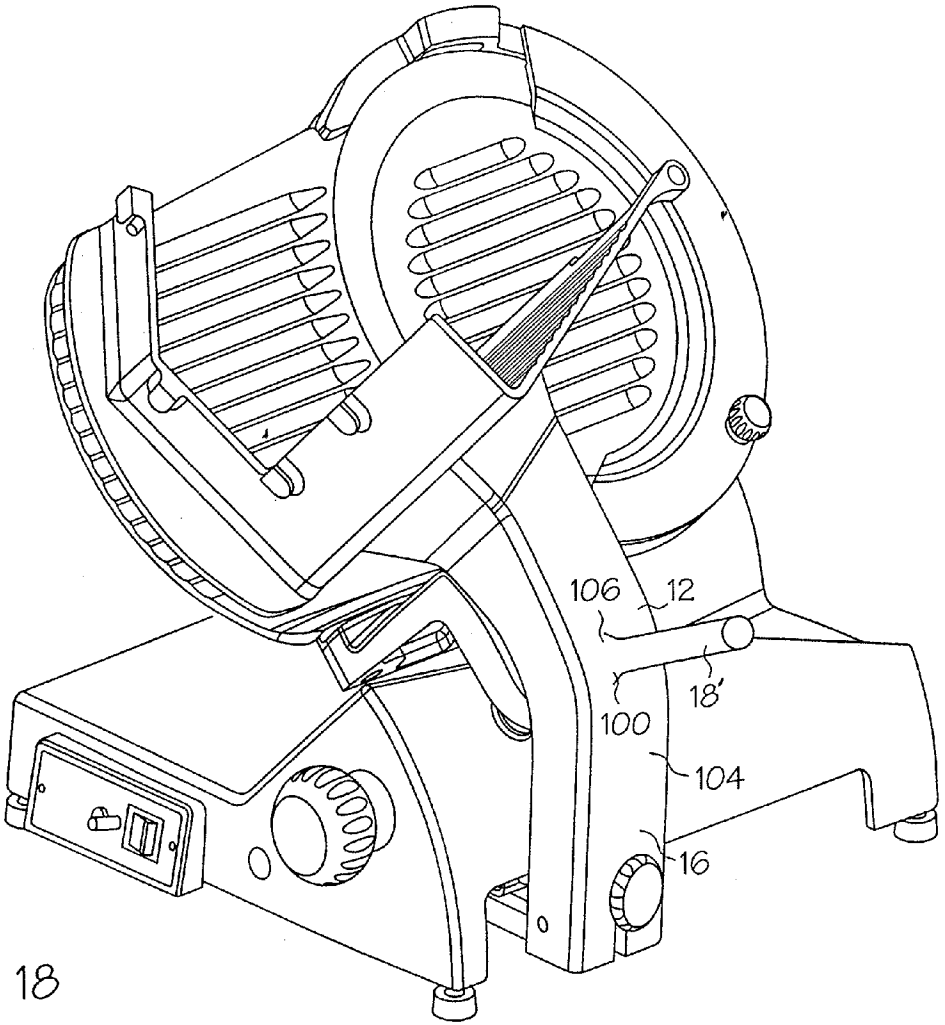
FIG. 18 is a perspective side view of a slicer with an alternate embodiment of the tray of the present invention.

In an alternate embodiment shown in FIG. 18, the handle 18' includes only a single attachment point 100'. In this case, the handle 18' extends away from the body 104 of the tray 12. The handle 18' preferably extends generally away from the body 104 of the tray 12 adjacent the attachment point or attachment points; however, at locations away from the attachment points the handle 18' may extend in a variety of directions, including generally vertically, or form an angle with the tray 12. The handle 18' may also take a variety of shapes. However, in all cases the handle 18, 18' is preferably integral or unitary with the body of 104 of the tray 12.

The handle 18 and tray body 104 are preferably integrally formed of a single cast piece of material, such as aluminum. However, the tray 12 may be made from a variety of materials, including but not limited to various metals, plastic, fiberglass, composite materials, and the like.

Having described the invention in detail and by reference to the preferred embodiments, it will be apparent that modifications and variations thereof are possible without departing from the scope of the invention.

What is claimed is:

1. A slicer comprising:

a slicer body including a rotatable blade for slicing a product; and a tray mounted for reciprocal movement relative said slicer body, said tray including a tray body and a support surface for supporting and moving said product relative said blade, said tray including a handle unitary with said tray to be gripped for manually moving said tray, wherein said handle is located generally below said support surface and extends from said tray at at least two spaced locations, and wherein said tray body and said handle are a single, cast piece of metal.

2. The slicer of claim 1 wherein said handle defines an opening between said handle and said tray body, said opening being sized to receive a user's fingers therethrough such that said handle can be gripped in said user's palm.

3. The slicer of claim 1 wherein said tray body includes a recessed area extending between said at least two spaced locations.

4. The slicer of claim 1 wherein said handle extends away from one of said locations and towards the other of said locations in a generally arcuate shape.

5. The slicer of claim 1 wherein said slicer includes a home position and an away position, and wherein said tray is mounted to said slicer body for reciprocation between said home position and said away position, and wherein said handle is angled towards said home position relative said tray body.

6. The slicer of claim 1 wherein said handle protrudes generally outwardly from said tray body to provide a gripping surface.

7. The slicer of claim 1 wherein said tray body and said handle are aluminum.

8. The slicer of claim 1 wherein said tray includes at least two generally curved surfaces, each surface being located adjacent to one of said at least two locations to form a smooth transition between said tray body and said handle.

9. The slicer of claim 1 wherein said support surface is generally "V" shaped.

10. The slicer of claim 1 wherein said tray is movable along a slicing path that is generally perpendicular to a central axis of said blade.

11. The slicer of claim 1 wherein said handle is generally spaced apart from said support surface.

12. The slicer of claim 1 wherein said tray body extends generally downwardly from said support surface, and wherein said handle is unitary with said tray body.

13. The slicer of claim 1 wherein said tray body extends generally downwardly from said support surface, and wherein said handle extends from said tray body at least partially along a direction of said reciprocal movement.

14. A slicer comprising:

a slicer body including a rotatable blade for slicing a product;

a tray including a tray body and a support surface for supporting said product and moving said product relative said blade; and a handle unitary with said tray body, said handle providing a surface which a user may grip to manually move said tray, wherein said tray body is located generally below said support surface and said handle extends from said tray body at at least two spaced locations, and wherein said tray body and said handle are a single, cast piece of metal.

15. The slicer of claim 14 further including a pair of generally curved surfaces, each surface extending between said tray body and said handle.

16. The slicer of claim 14 wherein said tray body includes a recessed area located adjacent said handle.

17. The slicer of claim 14 wherein said handle is generally spaced apart from said support surface.

18. The slicer of claim 14 wherein said tray body extends generally downwardly from said support surface.

19. The slicer of claim 14 wherein said tray body extends generally downwardly from said support surface, and wherein said handle extends from said tray body at least partially along a direction of said movement of said product relative to said blade.

20. A tray shaped to be mounted to a slicer body for reciprocal movement relative said slicer body, said tray having a tray body and a support surface for supporting a product such that said tray can bring said product into and out of contact with a rotatable blade of said slicer body, said tray including a unitary handle located generally below said support surface and extending from said tray at at least two spaced locations, and wherein said handle extends generally vertically between said at least two spaced locations.

21. The tray of claim 20 wherein said handle is generally spaced apart from said support surface.

22. The tray of claim 20 wherein said tray body extends generally downwardly from said support surface, and wherein said handle is unitary with said tray body.

23. The tray of claim 20 wherein said tray body extends generally downwardly from said support surface, and wherein said handle extends from said tray body at least partially along a direction of said movement of said product relative to said blade when said tray is mounted to a slicer body.

24. A slicer comprising:

a slicer body including a rotatable blade for slicing a product; and a tray mounted for reciprocal movement relative said slicer body, said tray including a tray body and a support surface for supporting and moving said product relative said blade, said tray including a handle unitary with said tray to be gripped for manually moving said tray, wherein said handle is located generally below said support surface and extends from said tray at at least two spaced locations, and wherein said handle extends generally vertically between said at least two spaced locations.

25. A slicer comprising:

a slicer body including a rotatable blade for slicing a product;

a tray including a tray body and a support surface for supporting said product and moving said product relative said blade; and a handle unitary with said tray body, said handle providing a surface which a user may grip to manually move said tray, wherein said tray body is located generally below said support surface and said handle extends from said tray body at at least two spaced locations, wherein said handle extends generally vertically between said at least two spaced locations.

* * * * *